US012163698B2

(12) United States Patent
Süss et al.

(10) Patent No.: US 12,163,698 B2
(45) Date of Patent: Dec. 10, 2024

(54) COOLING DEVICE, METHOD FOR MANUFACTURING A COOLING DEVICE, AND TRANSPORT DEVICE HAVING A COOLING DEVICE

(71) Applicant: Efficient Energy GmbH, Feldkirchen (DE)

(72) Inventors: Jürgen Süss, Bodolz (DE); Oliver Kniffler, Sauerlach (DE)

(73) Assignee: VERTIV S.R.L., Piove di Sacco (IT)

( * ) Notice: Subject to any disclaimer, the term of this patent is extended or adjusted under 35 U.S.C. 154(b) by 307 days.

(21) Appl. No.: 17/565,742

(22) Filed: Dec. 30, 2021

(65) Prior Publication Data

US 2022/0120477 A1 Apr. 21, 2022

Related U.S. Application Data

(63) Continuation of application No. PCT/EP2020/069145, filed on Jul. 7, 2020.

(30) Foreign Application Priority Data

Jul. 8, 2019 (DE) ..... 10 2019 210 039.2

(51) Int. Cl.
*F25B 13/00* (2006.01)
*F25D 21/14* (2006.01)

(52) U.S. Cl.
CPC ..... *F25B 13/00* (2013.01); *F25D 21/14* (2013.01)

(58) Field of Classification Search
CPC ..... F25B 13/00; F25D 21/14
See application file for complete search history.

(56) References Cited

U.S. PATENT DOCUMENTS 3,255,603 A 6/1966 Johnson et al.
11,079,146 B2 8/2021 Kniffler et al.
(Continued)

FOREIGN PATENT DOCUMENTS

CN 104344585 A 2/2015
CN 105571091 A 5/2016
(Continued)

OTHER PUBLICATIONS

Japanese language office action dated Feb. 1, 2023, issued in application No. JP 2022-502087.
(Continued)

*Primary Examiner* — Elizabeth J Martin
(74) *Attorney, Agent, or Firm* — McClure, Qualey & Rodack, LLP

(57) ABSTRACT

A cooling device having a vaporizer for vaporizing a working liquid, wherein the working liquid is held on a vaporizer bottom; a compressor for compressing a vaporized working liquid, wherein the compressor is configured to convey the vaporized working liquid from the bottom to the top in a setup direction; a liquefier having an upper wall configured such that the vaporized and compressed working liquid is condensable at the upper wall and drips down from top to bottom; and an intermediate bottom configured to collect a dripped-down working liquid, wherein the intermediate bottom comprises at least one opening through which the dripped-down working liquid may reach the vaporizer bottom.

46 Claims, 6 Drawing Sheets

(56) References Cited

U.S. PATENT DOCUMENTS

| | | | | |
|---|---|---|---|---|
| 2009/0100857 | A1 | 4/2009 | Ophir et al. | |
| 2011/0146316 | A1* | 6/2011 | Sedlak | F28F 13/182 165/109.1 |
| 2014/0150490 | A1 | 6/2014 | Kang | |
| 2018/0073784 | A1* | 3/2018 | Kniffler | F25B 39/04 |
| 2018/0363958 | A1 | 12/2018 | Kniffler et al. | |
| 2018/0363959 | A1 | 12/2018 | Kniffler et al. | |
| 2018/0363960 | A1 | 12/2018 | Kniffler et al. | |
| 2020/0200447 | A1 | 6/2020 | Kniffler | |

FOREIGN PATENT DOCUMENTS

| | | | |
|---|---|---|---|
| CN | 207365509 | U | 5/2018 |
| CN | 207991218 | U | 10/2018 |
| CN | 109073289 | A | 12/2018 |
| CN | 109073302 | A | 12/2018 |
| DE | 10 2015 209848 | A1 | 12/2016 |
| DE | 10 2016 203414 | B4 | 1/2019 |
| DE | 10 2017 217 730 | A1 | 2/2019 |
| JP | U-57-137924 | | 8/1982 |
| JP | 2008-531965 | A | 8/2008 |
| JP | 2019-507310 | A | 3/2019 |
| WO | 96/31750 | A1 | 10/1996 |
| WO | 2019/042825 | A1 | 3/2019 |

OTHER PUBLICATIONS

English language translation of office action dated Feb. 1, 2023, issued in application No. JP 2022-502087.

Chinese language office action dated Dec. 28, 2022, issued in application No. CN 202080050281.5.

English language translation of office action dated Dec. 28, 2022, issued in application No. CN 202080050281.5 (pp. 1-8 of attachment).

International Search Report and Written Opinion issued in application No. PCT/EP2020/069145.

Translation of Search Report issued in application No. PCT/EP2020/069145.

Chinese language office action dated Feb. 2, 2024, issued in application No. CN 202080050281.5.

English language counterpart to office action dated Feb. 2, 2024 (pp. 1-4 of attachment.

* cited by examiner

COOLING DEVICE, METHOD FOR MANUFACTURING A COOLING DEVICE, AND TRANSPORT DEVICE HAVING A COOLING DEVICE

CROSS-REFERENCES TO RELATED APPLICATIONS

This application is a continuation of copending International Application No. PCT/EP2020/069145, filed Jul. 7, 2020, which is incorporated herein by reference in its entirety, and additionally claims priority from German Applications No. DE 10 2019 210 039.2, filed Jul. 8, 2019, which is incorporated herein by reference in its entirety.

BACKGROUND OF THE INVENTION

The present invention relates to cooling devices, and in particular to cooling devices having a compression heat pump.

DE 102016203414 B4 describes a heat pump having a foreign gas collection space, a method for operating a heat pump, and a method for manufacturing a heat pump. The heat pump includes a vaporizer for vaporizing a working liquid in a vaporizer space. Additionally provided is a condenser for liquefying a vaporized working liquid in a condenser space that is limited by a condenser bottom and holds a quantity of working liquid that is introduced into the condenser space as "rain" so as to achieve efficient condensation. The vaporizer space is at least partially surrounded by the condenser space. In addition, the vaporizer space is separated from the condenser space by the condenser bottom. An area to be cooled is connected to the vaporizer via a heat exchanger. In addition, an area to be heated is connected to the condenser via a heat exchanger as well. In particular, the heat pump is housed in a can-shaped housing in which the motor for a turbo compressor with a radial wheel is attached at an upper area, while every inlet and outlet for the working liquid in the liquefier and for the working liquid in the vaporizer are arranged in the lower area in the vaporizer bottom.

The known heat pump is not adapted in an optimal way with respect to low cooling capacities or when requiring a particularly compact structural shape. Therefore, such a heat pump cannot, or only with a large effort, be employed for applications with lower cooling capacities and a smaller space requirement.

Thus, the object of the present invention is to provide a cooling device that can be employed flexibly and is further suited for applications that make due with average or lower cooling capacities.

SUMMARY

According to an embodiment, a cooling device may have: a vaporizer for vaporizing a working liquid, wherein the working liquid is held on a vaporizer bottom; a compressor for compressing a vaporized working liquid, wherein the compressor is configured to convey the vaporized working liquid from the bottom to the top in a setup direction; a liquefier comprising an upper wall configured such that the vaporized and compressed working liquid is condensable at the upper wall and drips down from top to bottom; and an intermediate bottom configured to collect a dripped-down working liquid, wherein the intermediate bottom comprises at least one opening through which the dripped-down working liquid may reach the vaporizer bottom.

According to another embodiment, a method for manufacturing a cooling device may have the steps of: arranging a vaporizer for vaporizing a working liquid so that the working liquid is held on a vaporizer bottom, and above a liquefier, wherein the liquefier comprises an upper wall configured such that, at the upper wall, a vaporized working liquid compressed by a compressor is condensable and drips down from top to bottom; and arranging an intermediate bottom such that a dripped-down working liquid is collected, wherein the intermediate bottom comprises at least one opening through which the dripped-down working liquid may reach the vaporizer bottom.

According to another embodiment, a transport device or building may have: an interior space; a cooling device according to the invention, wherein the cooling device is arranged at the transport device or the building such that the vaporizer bottom is arranged in the interior space, and wherein the upper wall of the liquefier is in thermal contact with an area around the transport device or outside of the interior space of the building.

The present invention is based on the finding that a compact structural shape in case of average cooling capacities may be advantageously achieved by the fact that a working liquid is kept in an enclosed system on a vaporizer bottom in the vaporizer, the compressor conveys the vaporized working liquid from the bottom to the top in a setup direction, and the liquefier arranged at the top in the setup direction particularly comprises an upper wall configured so that the vaporized working liquid is condensable at the upper wall and drips down from the top to the bottom. The dripped-down working liquid is collected on an intermediate bottom comprising, as a throttle functionality, at least one or advantageously several openings through which the dripped-down working liquid may return to the vaporizer bottom. No significant supply of condenser liquid is held in the liquefier to support condensation. Instead, condensation is achieved at the upper wall of the liquefier.

This makes it possible to achieve a hermetically sealed system that is also operable at negative pressure. This is of particular advantage if water is used as a working liquid, water being particularly advantageous as a working liquid since it does not have a climate-damaging effect and, with respect to its special characteristics, is also particularly well suited for a heat pump with a compressor that is a radio compressor or turbo compressor. Due to its operation, such a compressor enables a pressure difference of up to five times, such that the pressure in the liquefier is five times the pressure in the vaporizer. At the same time, an efficient structural shape is achieved, since only a small amount of working liquid has to be held in, or on, the vaporizer bottom, however, a condensation is carried out at a cool wall, i.e. the upper wall of the condenser, typically being in thermal (direct) contact to the heating area. Thus, there is no liquefaction into a working liquid of the condenser held in the liquefier, which is typically in thermal (direct) contact to the heating area.

Thus, there is no liquefaction into a working liquid held in the liquefier, but the liquefaction is carried out at a wall that is cooler compared to the temperature of the compressed working vapor. Due to the setup direction, the condensed working liquid directly flows, or drips, from the upper wall and flows across the lateral wall back to the intermediate bottom. A throttle functionality is achieved there, again without larger installations, i.e. typically through one or several relatively thin holes through the collection bottom, so that the condensed working liquid ends up back in the vaporizer, and is again vaporized from there due to the thermal coupling of the vaporizer bottom and the area to be cooled. This provides an efficient cycle in a system that does not have to be filled. In addition, if this system will be evacuated and has on its internal pressures that are smaller than the atmospheric pressure, it will remain sealed on its own, since the upper unit with the liquefier and the lower unit with the vaporizer are typically pressed together due to the pressure between the two elements, which is smaller than the atmospheric pressure. By providing a corresponding seal between these two elements, a particularly high effort with respect to an additional sealing, or holding force, is not even required.

Advantageously, the cooling device is configured to be cuboid-shaped, i.e. with a relatively flat height and, relatively to the height, a larger extension perpendicular to the height, so that a relatively large area, such as a building ceiling or a vehicle interior space, may be realized by means of the vaporizer bottom, wherein the vaporizer bottom comes into direct contact with the area to be cooled. Thus, due to the compact structural shape, the upper wall of the liquefier does not extend too heavily beyond the building ceiling or the other limitation of the interior space of a vehicle, for example.

In embodiments, the upper wall of the liquefier and/or the vaporizer bottom may be configured to be lamellar. In other embodiments, these elements are configured as planar or smooth surfaces, and on these planar or flat elements there may be structures that represent fluid channels, e.g. lamella structures or the like.

In addition, the top side of the cooling device and the bottom side of the cooling device may each be provided with a ventilator so as to achieve a forced air flow or fluid flow along the two thermally active surfaces, i.e. along the vaporizer bottom on the one hand and the upper wall of the liquefier on the other hand, so as to ensure better heat transfer. In particular in the case of an installation in a transport device such as a land craft, a watercraft, or an aircraft, the headwinds alone may drive the ventilator associated with the upper wall of the liquefier. By, e.g. rigidly, coupling this ventilator to a ventilator associated with the vaporizer bottom, i.e. e.g. which is arranged in the interior space of the transport device, this ventilator may also be driven due to the headwinds, so as to achieve better cooling, however, without having to employ any effort, for example in an electrical manner.

In alternative embodiments, which are installed in building, for example, condensate that drips down from the ceiling may be collected with a drip tray so as to then bring this condensate into thermal contact with the upper wall of the liquefier in order to increase the efficiency of the inventive cooling device by means of additional vaporization cooling, or adiabatic cooling.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
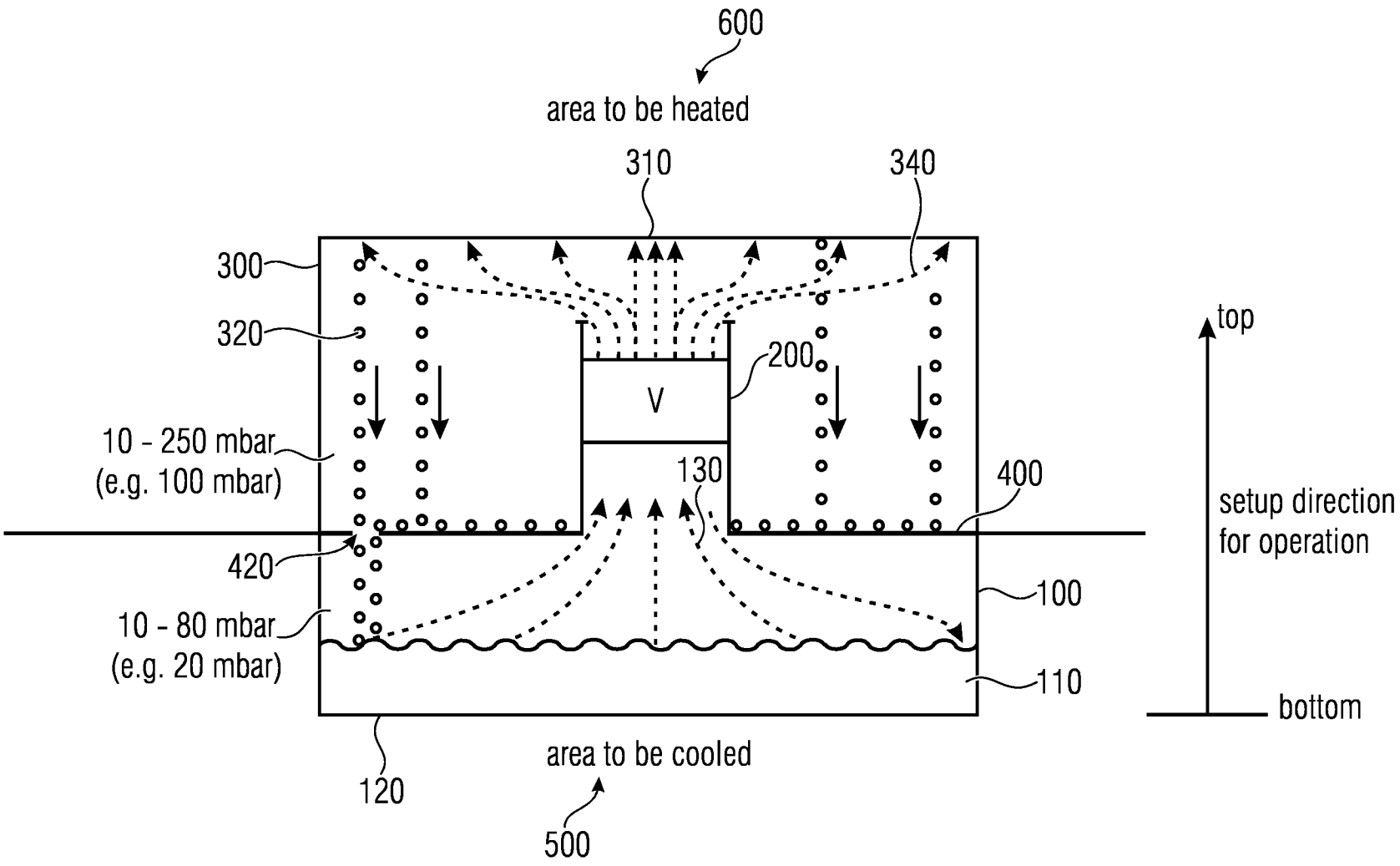
FIG. 1 shows a cooling device according to an embodiment of the present invention.

FIG. 1 shows a cooling device having a vaporizer 100 for vaporizing a working liquid 110, wherein the working liquid 110 is held on a vaporizer bottom 120. The cooling device further includes a compressor 200 for compressing a vaporized working liquid 130. The compressor is configured to convey the vaporized working liquid 130 from the bottom to the top in the setup direction, as it is shown in on the right side of FIG. 1. In particular, the setup direction is adopted for the operation of the cooling device. However, it is to be noted that the setup direction does not have to be perfectly perpendicular. Inclined setup directions may also be employed, however, it should be ensured that at least one vertical direction component of the gravitational force that may act on a condensed working liquid 320 remains so that it may drip from the top to the bottom. In particular, condensation is achieved by means of a liquefier 300, wherein the liquefier 300 comprises, in the setup direction, an upper wall 310 configured such that the working liquid 340 conveyed and compressed by the compressor is condensable at the upper wall, and, due to the condensation, drips down from the top to the bottom, as is illustrated at 320, wherein reference numeral 320 is to schematically illustrate the fall of the drops of condensed working liquid. In addition, the cooling device includes an intermediate bottom 400 configured to catch the dripped-down working liquid, as is illustrated by means of droplets in FIG. 1, drawn as lying on the intermediate bottom 400. In particular, the intermediate bottom further includes at least one opening 420 through which the dripped-down working liquid may reach the vaporizer bottom 120.

In particular, in an embodiment, the vaporizer bottom 120 may be brought into direct contact with an area to be cooled. Alternatively or additionally, the upper wall 310 of the liquefier may be brought into direct contact with an area to be heated.

Figure 3:
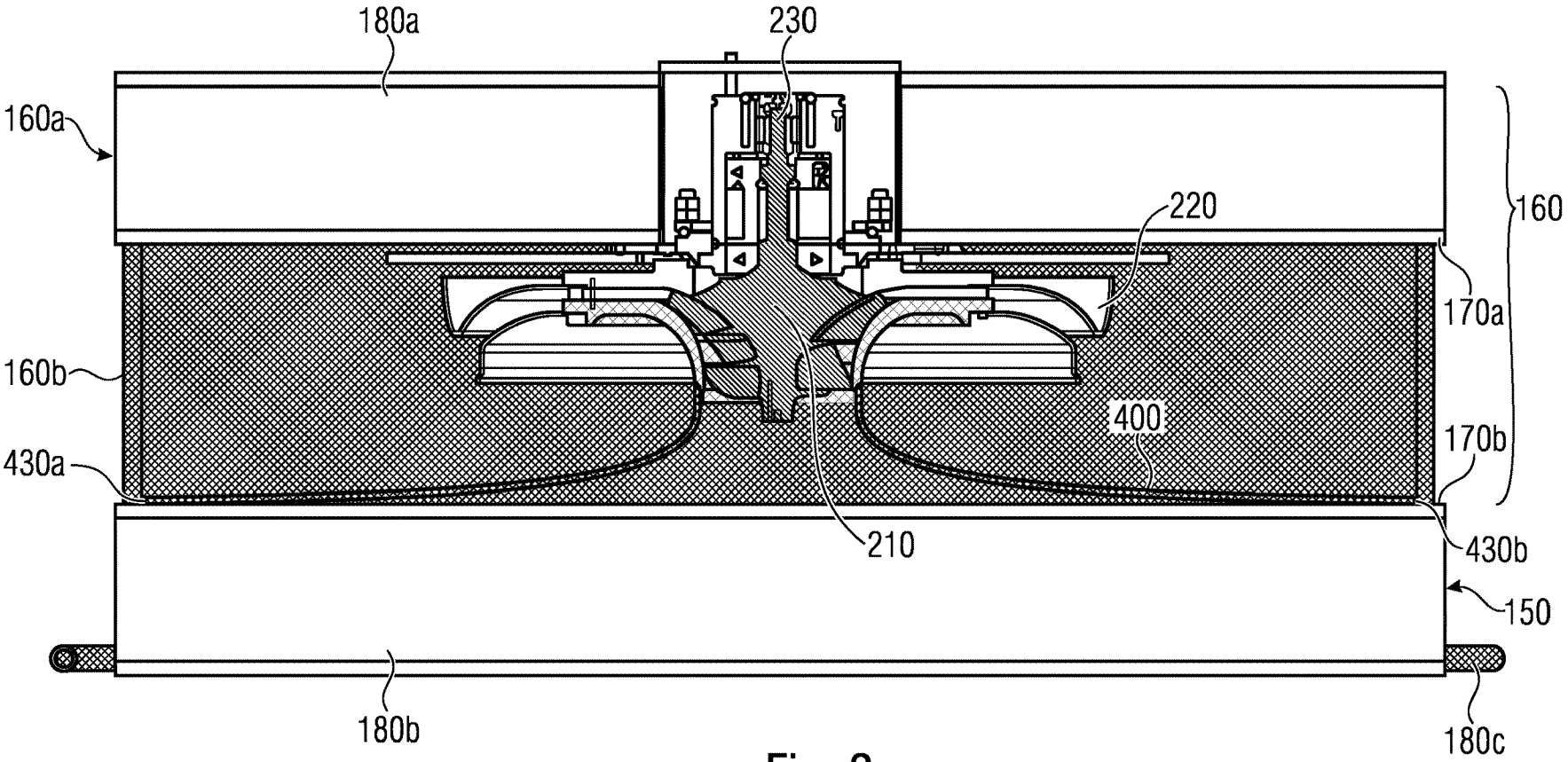
FIG. 3 shows a cross-section through a cooling device according to an embodiment, having non-planar thermally active surfaces.
Figure 4:
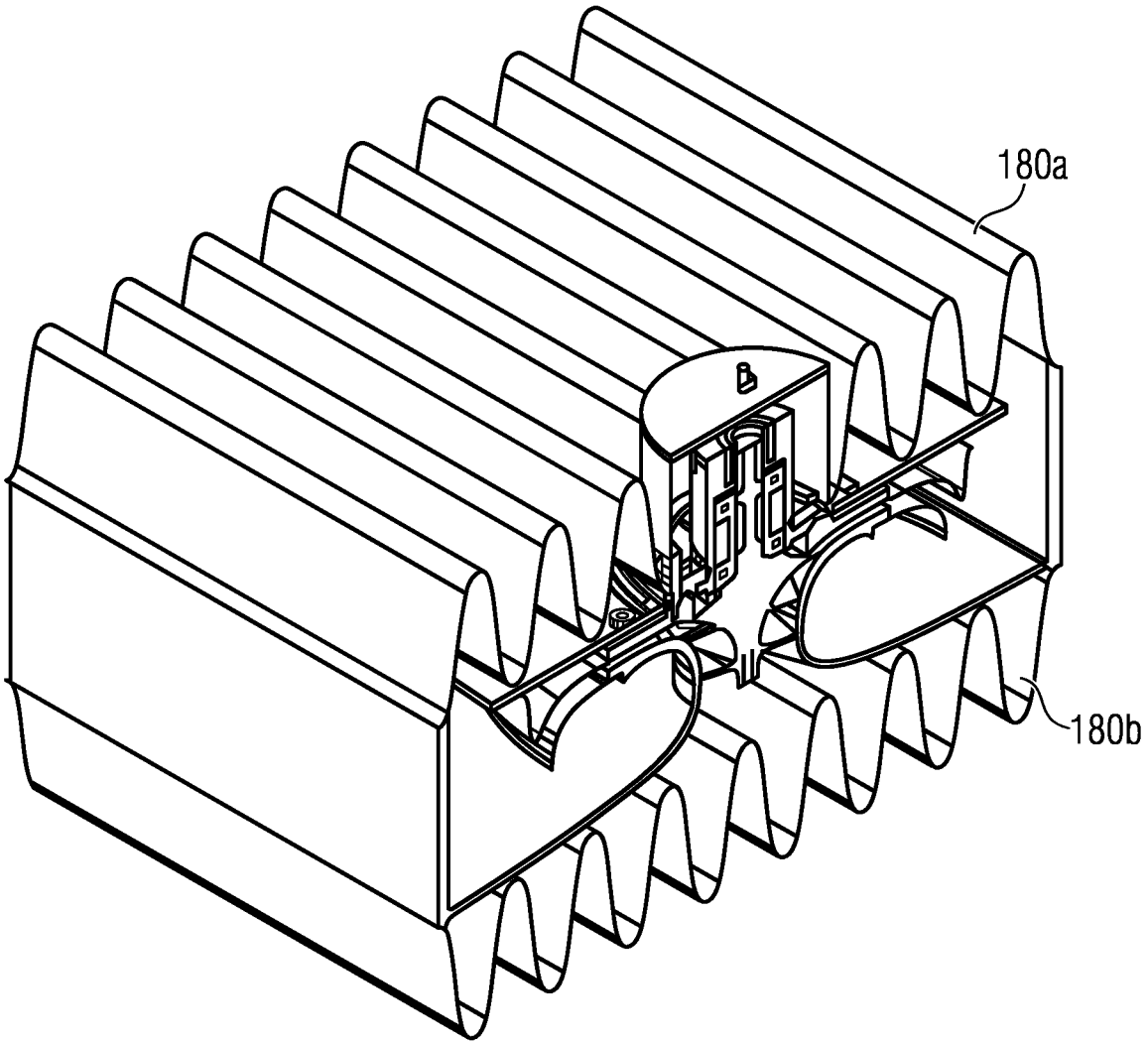
FIG. 4 shows a cross-sectional top view of the cooling device of FIG. 3.

In an embodiment of the present invention, as is shown in FIG. 3 or FIG. 4, for example, the compressor 200 is configured as a turbo compressor comprising a compressor wheel 210 and a conduction path 220 for the vapor conveyed by the compressor wheel 210 from the bottom to the top. In addition, the turbo compressor includes a drive motor 230 for the compressor wheel 210. In a special embodiment, the vaporizer 100 is configured as a lower unit 150, and the liquefier 300 is configured as an upper unit 160. As is exemplarily shown in FIG. 3, the upper unit 160 may be divided into a motor receiving unit or upper partial unit 160*a*, which, in case of the embodiment shown in FIG. 3, is simultaneously configured as an upper wall in a channel structure such as a lamella structure. The upper unit 160 is completed by a central unit 160*b*, or a lower area comprising the intermediate bottom and the radial wheel 210 including a conduction path structure 220. In particular, the compressor wheel 210 is arranged in the central area 160*b* and the motor 230 extends into the upper unit.

In an embodiment of the present invention, the cooling device, as is illustrated in the drawings, uses water as a cooling agent. In particular, the liquefier 100 is configured to operate/work at a liquefier pressure below 300 mbar, wherein pressures between 10 and 250 mbar and pressures around 100 mbar are advantageous in particular. In addition, the vaporizer is configured to work/operate at a vaporization pressure that is smaller than the liquefaction pressure, and in particular at a vaporizer pressure that is smaller than 150 mbar and is advantageously 10 and 80 mbar, and in particularly embodiments is at below 20 mbar.

In the embodiment of the present invention, as is shown in FIG. 1, the vaporizer bottom is configured as a lower heat transmitter towards the area 500 to be cooled. In addition, the upper wall 310 of the liquefier is also configured as an upper heat transmitter. In addition, the compressor 200 and the intermediate bottom are configured in the central unit, as is exemplarily shown at 160*b* in FIG. 3, wherein seals 170*a*, 170*b* are arranged at interfaces between the units, and wherein the cooling device is operated at internal pressures that are smaller than half of the atmospheric pressure, so that the upper partial unit, which is shown at 160*a* in FIG. 3, and the lower unit, which is shown at 150 in FIG. 3, each put pressure on the central unit and the seals 170*a*, 170*b* between the units, so that automatic sealing is achieved when the cooling device has been evacuated, in order to make the same be operable.

Figure 5:
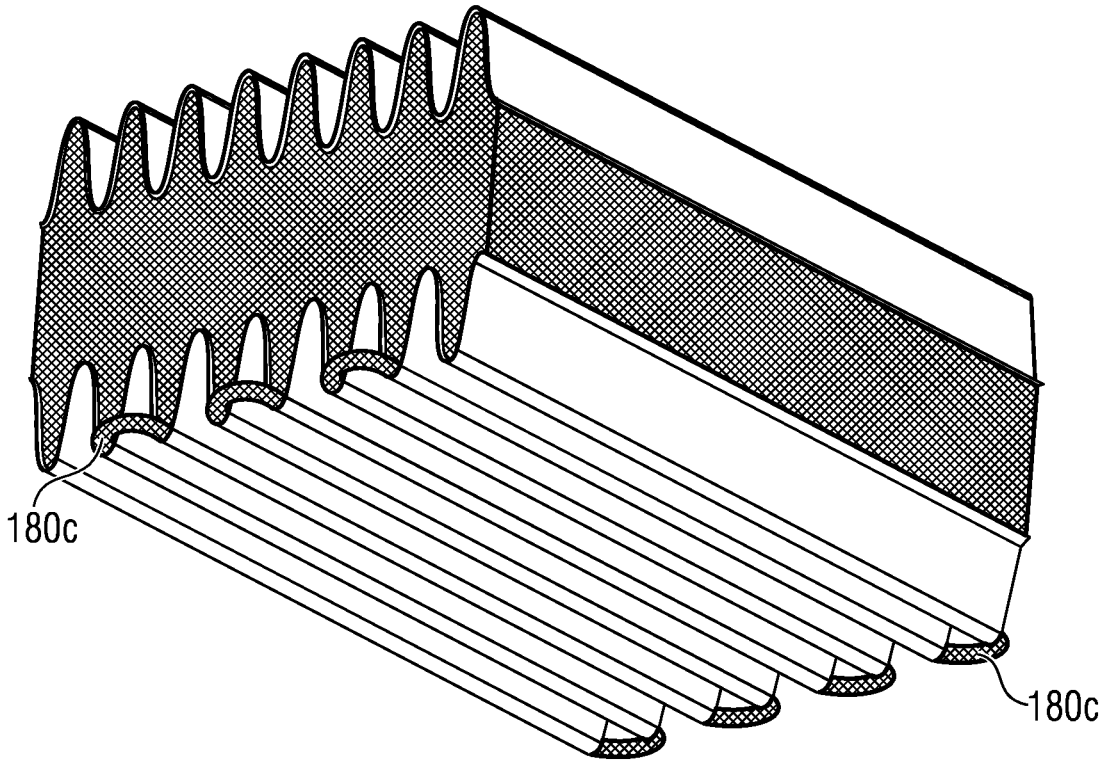
FIG. 5 shows a perspective bottom view of the cooling device of FIG. 3.
Figure 6:
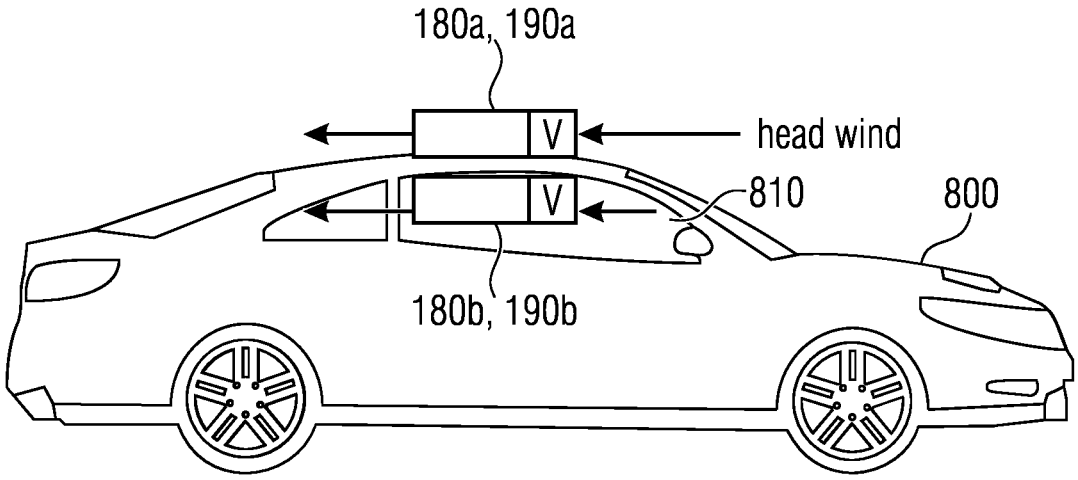
FIG. 6 shows a transport device having a cooling device installed.
Figure 7:
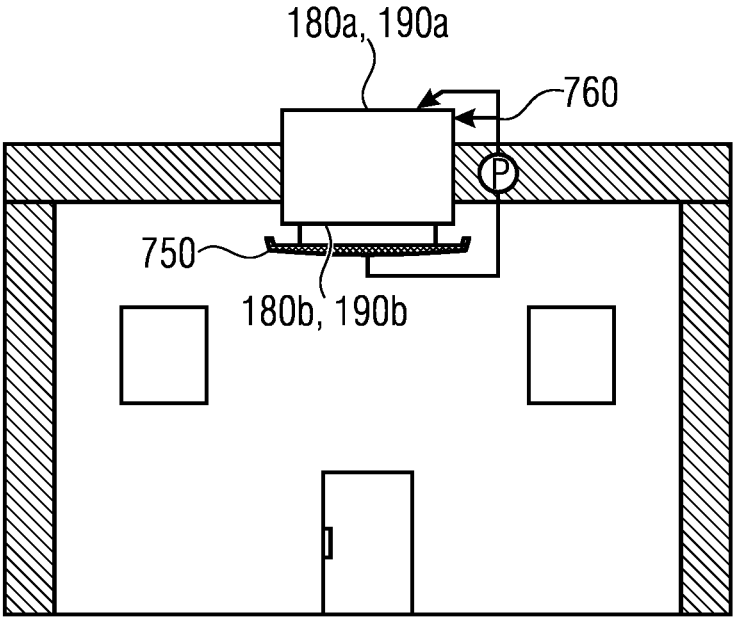
FIG. 7 shows a building having a cooling device installed.

As is exemplarily illustrated in FIGS. 4 and 5, the cooling device is advantageously configured to be cuboid-shaped so as to be able to be housed efficiently in building ceilings, as is exemplarily illustrated in FIG. 7, or in vehicle roofs, as is exemplarily illustrated in FIG. 6. Advantageously, such a cuboid-shaped implementation has a height of less than 50 cm and/or has a length or width of less than 100 cm. In addition, it is advantageous that the length or width is larger than the height so as to obtain a flat device. While the embodiment shown in FIG. 1 shows a cooling device with a flat upper wall 310, or a flat vaporizer bottom, FIGS. 3 to 5 show a cooling device in which the upper wall 310 is configured as a lamella wall 180*a*, and wherein the lower wall, or the vaporizer bottom 120, is configured as a lamella wall 180*b*. It is advantageous, in case of an setup direction according to plan, that an essentially uniform working level liquid is formed along the vaporizer bottom, i.e. in the lamella wall. The working liquid filling in the cooling device is dimensioned such that a level of the working liquid, as is schematically illustrated at 110 in FIG. 1, is between 10% and 70% of the lamella height of the vaporizer bottom. In embodiments, the filling is at approximately 50% of the lamella height. If, in the alternative of FIG. 1, the vaporizer bottom 120 is configured to be planar, a working liquid height, or a working liquid level, of less than 10% of the overall height of the cooling device is advantageous.

The area 600 to be heated and the area 500 to be cooled, as illustrated in FIG. 1, are directly arranged at the vaporizer bottom 120 and the upper wall 310 of the liquefier, respectively. To achieve good heat transmission, a wall thickness of the upper wall 310, or the vaporizer bottom, is advantageous to be less than 3 mm is, and advantageously less than 1 mm. In the embodiment shown in FIG. 2, which shows an implementation of the embodiment shown in FIG. 1 with a planar upper wall 310 and a planar vaporizer bottom 120, a structure for forming fluid channels, such as the lamella structure, is configured, however, wherein, in contrast to the embodiments shown in FIG. 4, the bottom side of the lamellas, or the structure 190*a*, is not in contact with the working vapor, but is arranged outside of the negative pressure area. The same applies for the structures 190*b* that arranged at the vaporizer bottom, but are not attached within the negative pressure area.

Figure 2:
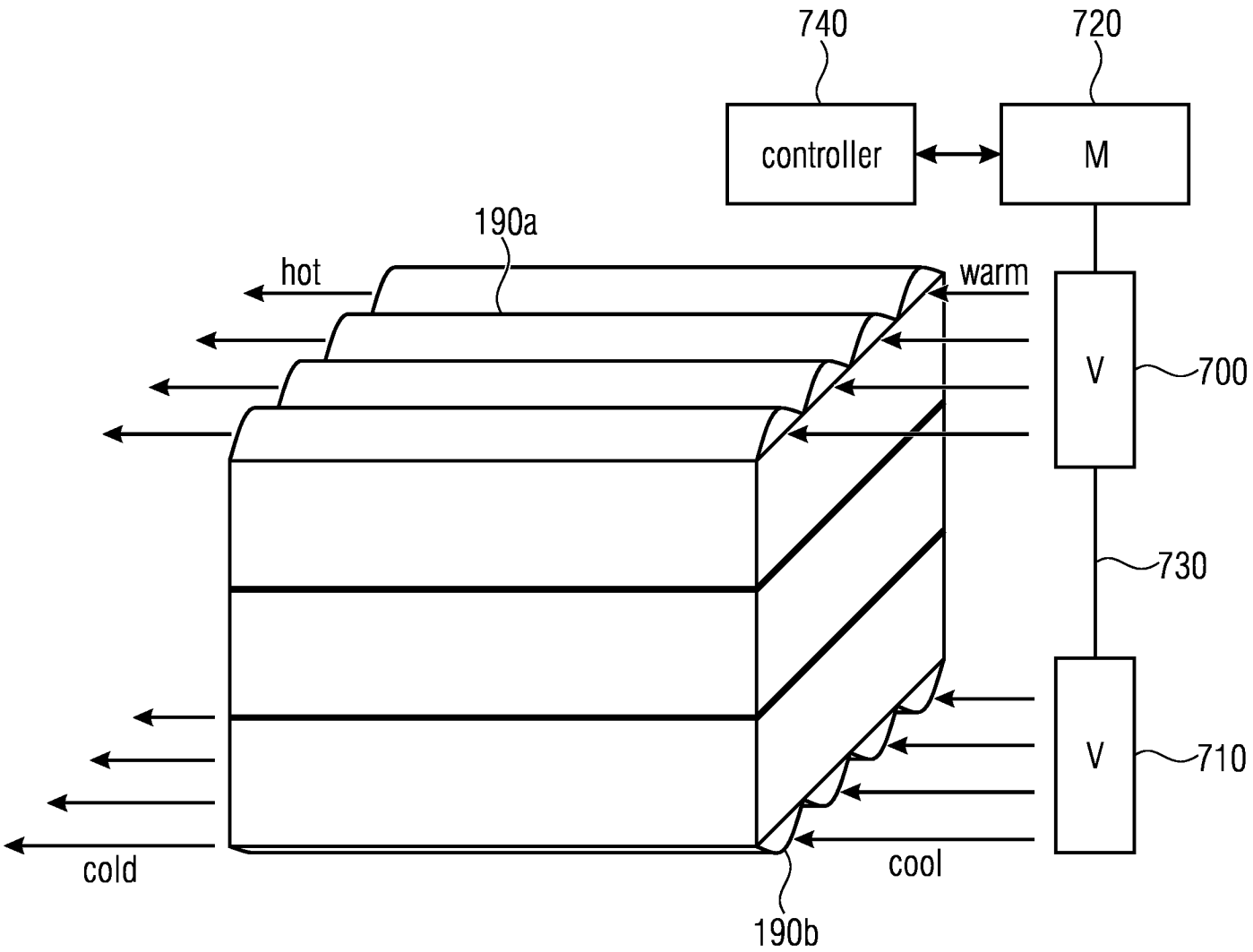
FIG. 2 shows a schematic perspective view of a cooling device according to a further embodiment, having fluid channel structures applied.

In the embodiment shown in FIG. 2, a liquefier-side ventilator 700 that guides a comparably warm air or warm liquid through the structure 190 along the upper wall 310 of the liquefier 300 is advantageously arranged so that the warm fluid is heated and exits as hot fluid. Accordingly, the ventilator 710 is arranged to convey comparably cool air, or a cool liquid, or generally speaking a cool fluid, into the structure 190*b*, wherein the cool fluid is further cooled down through interaction with the vaporizer bottom and exits the structure 190*b* as a cold fluid. The rotational axes of the two ventilators 700, 710 are advantageously coupled so that a forced rotation of the ventilator 700 that occurs when the upper structure is subjected to a headwind in case of the cooling device being arranged in the roof of a vehicle, as is shown in FIG. 6, also generates a forced movement of the ventilator 710. Due to the headwind, this generates ventilation in the vehicle interior space through the structure 190*b* without energy expenditure so as to improve a cooling functionality, or heat transmission, between the medium in the structure 190*b* to be cooled and the vaporizer bottom 120. Depending on the implementation, a motor 720 may be provided, for example, to generate ventilation while standing, when there is no headwind. Alternatively or additionally, if the vehicle drives too slowly, or requires higher cooling capacity that cannot be achieved by means of the operation of the compressor, the ventilators may be driven by means of the motor. Depending on the implementation, the motor 720 may be coupled to a controller 740 that transmits the rotational speed of the ventilator 700, or the two ventilators 700, 710, and in case of the rotational speed being too high either decelerates the motor 720, or activates a generator function so as to generate current and output it to the system in order to decelerate the shaft 730. This current may either be input into an electricity network such as the on-board electrical system of a vehicle, or may be used directly in order to drive the compressor. However, if the rotational speed is too slow, the motor may drive the ventilator 700, and therefore also the ventilator 710, in addition to the headwind so as to achieve a desired rotational speed.

Even though the embodiment shown in FIG. 1 illustrates only one opening 420, it is advantageous to provide several openings, such as four, at each corner of the intermediate bottom, such corner positions being indicated at 430*a* and 430*b* in FIG. 3. This achieves that working liquid does not just reach the vaporizer 100 at one corner, or at one side, from the topside of the intermediate bottom 400, but that this is possible at several locations, directly enabling tilting of the cooling device with respect to the optimal setup direction, as is illustrated in FIG. 1, while maintaining the functionality.

In addition, FIG. 3 shows a advantageous structuring of the intermediate bottom 400 as an ellipsoid that tapers upwards. This shape is advantageous in that the vaporizer space can be used in the entire extension of the cooling device, i.e. a lot of the surface area of the vaporizer bottom effectively contributes to vaporizing a working liquid that is then conveyed from the bottom to the top by means of the radial wheel 210 advantageously arranged in the center. In order to achieve a compression in the sense of the turbo compressor, the working vapor conveyed by the radial wheel 210 is brought into the conduction path 220 having a cross-section that opens up, wherein, in contrast to the embodiment shown in FIG. 1, due to the cross-section and the design and arrangement of the conduction path, there is a deflection of the working vapor so as to feed the working vapor essentially horizontally into the liquefier so that the working vapor efficiently distributes itself across the entire upper wall 310, obtaining a largest possible condenser surface area. Alternative compressors and alternative deflections are also possible, as is shown in FIG. 1, wherein, in FIG. 1, the vapor is conveyed from the bottom to the top without further deflection and then "finds" its way to the upper wall 310 in order to condense there and rain down onto the intermediate bottom in the form of water drops.

FIG. 6 shows a advantageous implementation of the present invention in a transport device, such as an automobile. Other transport devices, such as watercrafts, aircrafts, or other vehicles, requiring cooling of an interior space 810, may accordingly also be provided with a cooling device. The cooling device is advantageously installed into the roof of the interior space, in such a way that the upper wall having the lamella structure 180*a*, or the lamella structure outside of the upper wall, indicated with 190*a*, extends beyond the vehicle roof, so that the headwind may flow through this structure, such as the lamella structure, in order to drive a ventilator (V), if necessary. On the other hand, the vaporizer bottom having the lamella structure 180*b*, or the lamella structure 190*b* attached on the outside of the vaporizer bottom, extends into the vehicle interior space 810 to be cooled in order to cool the air located there and to provide a comfortable atmospheric environment for a driver. Depending on the implementation, the cooling device in FIG. 6 is provided with or without coupled ventilators. Even if only the headwind is available and no ventilation is achieved in the interior space by means of its own ventilator, comfortable cooling of the interior space 810 still takes place.

The embodiment shown in FIG. 7 schematically shows a building in which the cooling device is illustrated in a building ceiling, wherein, again, the lamella structure 180*a* of the upper wall, or the structure 190*a* attached outside at the upper wall, extends beyond the building, and the vaporizer bottom having the lamella structure 180*a*, or the structure 190*b* arranged in the vaporizer bottom, extends into the interior space of the housing to be cooled. Particularly in the case of humid environments, the condensate may drip down from the structure 180*a*, or 190*b*. This condensate is advantageously collected by a drip tray 750 and is brought into thermal contact with the structure 180*a*, or 190*a*, by means of a pipeline. To this end, a pump P may be employed in the pipeline. By applying this condensate liquid onto the upper wall, or in thermal contact with the upper wall, of the liquefier, additional cooling for heat dissipation by means of adiabatic cooling, i.e. evaporation cooling, is achieved. Through this, the upper wall is cooled for the working vapor to be condensed within the liquefier, and the condensation and therefore the overall heat pump process are accelerated.

The present invention is characterized by a compact structural shape. In particular, the direct vaporizer 100 and the direct liquefier 300 allow a good heat transfer into the air. The turbo compressor 200 is located in the center of the unit and generates the required pressure ratio depending on the outside temperature. The turbo compressor is advantageously driven with a current, however, depending on the implementation, it may also be driven directly in a mechanical way by the motor of the driving device. The cooling device operates with water as a cooling agent in the coarse vacuum, wherein vaporizer pressures of 10 mbar to 80 mbar and liquefier pressures from 10 mbar to 250 mbar are advantageous. Thus, the cooling device is always in a vacuum, so to speak. Through this, the heat transmitters are pressed onto the equipment from the top and the bottom in a tight manner by means of the atmospheric pressure. The equipment may be integrated into an intermediate ceiling of a building or on a vehicle roof, e.g. on the roof of a train, a bus, a truck, or any other transport device. Due to the turbo compressor, pressure differences between the cold side (lower side) and hot side (upper side) of up to 5 are possible. For small cooling capacities of 2 to 15 kW, the cooling device may be implemented in a very compact manner. The thin-walled corrugated sheet for realizing the lamellas generates the required surface area for the heat transfer on both sides. This enables the realization of air conditioners having a space requirement for the installation into an intermediate sealing of more than 0.5 $m^2$ to less than 2 $m^2$ depending on the cooling capacity. Due to the gravitational force, the water in the lower heat exchanger is distributed evenly. However, in embodiments, the lamellas should be at most half filled with water. In order to realize this, the lamellas are connected with corresponding balance elements 180*c*, depending on the implementation, configured as pipelines, as can be seen in FIG. 5 in the bottom view of the cooling device, in particular. The upper lamellas are used for liquefying the water vapor. The gravitational force makes the condensate drip down, and it collects on the intermediate bottom 400, which at the same time separates the two pressure areas. The lowest point and therefore the pressure point of separation is in all four corners. A thin drilled hole 420 with a diameter of more than 1 mm up to 6 mm is here located as a throttle, respectively.

In order to improve the heat exchange with the air, heat flow may be forced along the lamellas, as is particularly illustrated with reference to FIG. 2. The forced air flow is achieved by installing the two ventilators 710, 700 on the vaporizer side, and on the liquefier side, respectively. In addition, the two rotational axes of the ventilators are connected to each other, as is indicated by 730, so that the motor 720 may drive both ventilators. If the cooling device is integrated into a vehicle, the headwind may flow to the upper ventilator 700 and therefore drive the lower ventilator 710 by means of the rigid axis 730, without a motor. If a controller 740 is provided in addition to a motor 720, the controller 740 may monitor the rotational speed of the motor 720 and may drive the motor in case of too low a circulation, whereas the motor may take out power as a generator in case of high rotational speeds and therefore limit the rotational speed.

In particular, condensate may form on the cold side in case of very high humidity, as is illustrated with reference to FIG. 7. For the condensate to not drip down from the ceiling, the drip tray 750 is provided, which advantageously serves as a flow guide through the lamellas at the same time. The condensate is collected in the tray, and, at the deepest point in the tray, the condensate may either be pumped in front of the ventilator on the liquefier side by means of a pump (P), or the pressure difference of the accelerated flow generated due to the ventilator "pulling" the condensate from the conduit is already sufficient for drawing in the condensate, without the presence of a pump. The condensate improves the heat transfer on the liquefier side by means of adiabatic cooling.

In a method for manufacturing the cooling device, in the operation direction of the cooling device, the vaporizer is arranged above the liquefier, and the intermediate bottom is arranged between the vaporizer and the liquefier so as to collect the dripped-down working liquid. In addition, an opening through which the dripped-down working liquid may reach the vaporizer bottom is provided in the intermediate bottom.

Depending on the embodiment, instead of a lamella-like bottom, a planar vaporizer bottom may be used. The cooling liquid, e.g. which is water, then stands as a planar "puddle" on the vaporizer bottom. Additionally or alternatively, the upper wall of the liquefier may also be configured to be planar and not lamella-like.

Advantageously, accordingly-described lamella structures through which brine or any other liquid cooling medium instead of air may be guided are attached below the vaporizer bottom or the liquefier cover.

In addition, the surface structure may be configured accordingly to provide condensation/vaporization seeds.

The advantage of the "sandwich" of the cooling device, which may be configured to be round or angular, also consists in the fact that it is suited for outside use, since the water may freeze without resulting in any damages, seeing as the water is not guided in tubes or the like. The cooling device in its "sandwich" implementation is a hermetically closed system without interfaces to the surroundings.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

LIST OF REFERENCE NUMERALS

100 vaporizer
110 working liquid
120 vaporizer bottom
130 vaporized working liquid
150 lower unit
160 upper unit
160*a* upper partial unit
160*b* central unit
170*a* upper seal
170*b* lower seal
180*a* upper lamellar structure
180*b* lower lamellar structure
180*c* balance conduit
190*a* upper structure
190*b* lower structure
200 compressor
210 compressor wheel
220 guide path
230 compressor motor
300 liquefier
310 upper wall of the liquefier
320 dripped-down working liquid
340 vaporized and compressed working liquid
400 intermediate bottom
420 opening in the intermediate bottom
430*a* deepest possible point
430*b* deepest possible point
500 area to be cooled
600 area to be heated
700 liquefier-side ventilator
710 vaporizer-side ventilator
720 motor
730 connection axis
740 controller
750 drip tray
760 condensate conduit
800 transport device
810 interior space

The invention claimed is:

1. A cooling device, comprising:

a vaporizer for vaporizing a working liquid, wherein the working liquid is held on a vaporizer bottom;

a compressor for compressing a vaporized working liquid, wherein the compressor is configured to convey the vaporized working liquid from a bottom of the cooling device to a top of the cooling device in a setup direction that is adopted for the operation of the cooling device;

a liquefier comprising an upper wall configured such that the vaporized and compressed working liquid is condensable at the upper wall and drips down from top to bottom; and an intermediate bottom configured to collect a dripped-down working liquid, wherein the intermediate bottom comprises at least one opening through which the dripped-down working liquid may reach the vaporizer bottom;

wherein the vaporizer is configured as a lower unit, and the vaporizer bottom is configured as a lower heat transmitter, wherein the liquefier is configured as an upper partial unit, and the upper wall is configured as an upper heat transmitter, wherein the compressor and the intermediate bottom are configured in a central unit, and wherein seals are configured at interfaces between the units and the upper partial unit, respectively, and wherein the cooling device is operated at an internal pressure of less than half of the atmospheric pressure so that, due to the atmospheric pressure, the upper partial unit and the lower unit are pressed onto the central unit.

2. A cooling device, comprising:

a vaporizer for vaporizing a working liquid, wherein the working liquid is held on a vaporizer bottom;

a compressor for compressing a vaporized working liquid, wherein the compressor is configured to convey the vaporized working liquid from a bottom of the cooling device to a top of the cooling device in a setup direction that is adopted for the operation of the cooling device;

a liquefier comprising an upper wall configured such that the vaporized and compressed working liquid is condensable at the upper wall and drips down from top to bottom; and an intermediate bottom configured to collect a dripped-down working liquid, wherein the intermediate bottom comprises at least one opening through which the dripped-down working liquid may reach the vaporizer bottom, wherein the upper wall is configured as a lamella wall, and/or wherein the vaporizer bottom is configured as a lamella wall, wherein the lamella bottom comprises at least one lamella balance element so that an essentially uniform working liquid level is formed along the lower lamella wall, and wherein a working liquid filling in the cooling device is dimensioned such that a level of the working liquid on the vaporizer bottom is between 10 and 70% of a lamella height of the lower lamella element.

3. A transport device or building, comprising:

an interior space;

the cooling device according to claim 2, wherein the cooling device is arranged at the transport device or the building such that the vaporizer bottom is arranged in the interior space, and wherein the upper wall of the liquefier is in thermal contact with an area around the transport device or outside of the interior space of the building.

4. The cooling device according to claim 2, wherein the vaporizer bottom is configured to be brought into direct contact with an area to be cooled, in use, and/or wherein the upper wall of the liquefier is configured to be brought into direct contact with an area to be heated, in use.

5. The cooling device according to claim 2, wherein the compressor is configured as a turbo compressor comprising a compressor wheel, a conduction path for a working vapor conveyed by the compressor wheel, and a drive motor for the compressor wheel, wherein the vaporizer is configured as a lower unit, and wherein the liquefier is configured as an upper partial unit, wherein the vaporizer wheel and the conduction space are located between the lower unit and the upper partial unit, and wherein the drive motor extends into the upper partial unit.

6. The cooling device according to claim 2 configured to use water as a cooling agent, wherein the liquefier is configured to operate at a liquefier pressure below 300 mbar, and wherein the vaporizer is configured to operate at a vaporizer pressure that is less than the liquefier pressure and is below 150 mbar.

7. The cooling device according to claim 2 comprising a cuboid-shaped dimension with a height of less than 50 cm and a length or width of less than 100 cm.

8. The cooling device according to claim 2 wherein a wall thickness of the upper wall and/or the vaporizer bottom is less than 1 mm, or wherein the vaporizer bottom or the upper wall are made of metal.

9. A transport device or building, comprising:

an interior space;

the cooling device according to claim 1, wherein the cooling device is arranged at the transport device or the building such that the vaporizer bottom is arranged in the interior space, and wherein the upper wall of the liquefier is in thermal contact with an area around the transport device or outside of the interior space of the building.

10. The cooling device according to claim 1, wherein the vaporizer bottom is configured to be brought into direct contact with an area to be cooled, in use, and/or wherein the upper wall of the liquefier is configured to be brought into direct contact with an area to be heated, in use.

11. The cooling device according to claim 1, wherein the compressor is configured as a turbo compressor comprising a compressor wheel, a conduction path for a working vapor conveyed by the compressor wheel, and a drive motor for the compressor wheel, wherein the vaporizer is configured as a lower unit, and wherein the liquefier is configured as an upper partial unit, wherein the vaporizer wheel and the conduction space are located between the lower unit and the upper partial unit, and wherein the drive motor extends into the upper partial unit.

12. The cooling device according to claim 1 configured to use water as a cooling agent, wherein the liquefier is configured to operate at a liquefier pressure below 300 mbar, and wherein the vaporizer is configured to operate at a vaporizer pressure that is less than the liquefier pressure and is below 150 mbar.

13. The cooling device according to claim 1 comprising a cuboid-shaped dimension with a height of less than 50 cm and a length or width of less than 100 cm.

14. The cooling device according to claim 1 wherein a wall thickness of the upper wall and/or the vaporizer bottom is less than 1 mm, or wherein the vaporizer bottom or the upper wall are made of metal.

15. A cooling device, comprising:

a vaporizer for vaporizing a working liquid, wherein the working liquid is held on a vaporizer bottom;

a compressor for compressing a vaporized working liquid, wherein the compressor is configured to convey the vaporized working liquid from a bottom of the cooling device to a top of the cooling device in a setup direction that is adopted for the operation of the cooling device;

a liquefier comprising an upper wall configured such that the vaporized and compressed working liquid is condensable at the upper wall and drips down from top to bottom; and an intermediate bottom configured to collect a dripped-down working liquid, wherein the intermediate bottom comprises at least one opening through which the dripped-down working liquid may reach the vaporizer bottom, wherein the upper wall is configured to be planar, and wherein a structure for providing a plurality of fluid channels through which the air or liquid as a cooling medium for the upper wall is able to be guided is attached on the upper wall and outside of an interior space of the cooling device, and/or wherein the vaporizer bottom is configured to be planar, and wherein, at the vaporizer bottom, a structure for providing a plurality of fluid channels through which the air or liquid may be guided as a medium to be cooled is configured outside of an interior space of the cooling device.

16. The cooling device according to claim 15, wherein the planar surface of the upper wall in the interior of the cooling device or a surface of the vaporizer bottom in the interior of the cooling device is configured to be structured so as to provide a seed effect for vaporizer seeds or condensation seeds.

17. A transport device or building, comprising:

an interior space;

the cooling device according to claim 15, wherein the cooling device is arranged at the transport device or the building such that the vaporizer bottom is arranged in the interior space, and wherein the upper wall of the liquefier is in thermal contact with an area around the transport device or outside of the interior space of the building.

18. The cooling device according to claim 15, wherein the vaporizer bottom is configured to be brought into direct contact with an area to be cooled, in use, and/or wherein the upper wall of the liquefier is configured to be brought into direct contact with an area to be heated, in use.

19. The cooling device according to claim 15, wherein the compressor is configured as a turbo compressor comprising a compressor wheel, a conduction path for a working vapor conveyed by the compressor wheel, and a drive motor for the compressor wheel, wherein the vaporizer is configured as a lower unit, and wherein the liquefier is configured as an upper partial unit, wherein the vaporizer wheel and the conduction space are located between the lower unit and the upper partial unit, and wherein the drive motor extends into the upper partial unit.

20. The cooling device according to claim 15 configured to use water as a cooling agent, wherein the liquefier is configured to operate at a liquefier pressure below 300 mbar, and wherein the vaporizer is configured to operate at a vaporizer pressure that is less than the liquefier pressure and is below 150 mbar.

21. The cooling device according to claim 15 comprising a cuboid-shaped dimension with a height of less than 50 cm and a length or width of less than 100 cm.

22. The cooling device according to claim 15 wherein a wall thickness of the upper wall and/or the vaporizer bottom is less than 1 mm, or wherein the vaporizer bottom or the upper wall are made of metal.

23. A cooling device, comprising:

a vaporizer for vaporizing a working liquid, wherein the working liquid is held on a vaporizer bottom;

a compressor for compressing a vaporized working liquid, wherein the compressor is configured to convey the vaporized working liquid from a bottom of the cooling device to a top of the cooling device in a setup direction that is adopted for the operation of the cooling device;

a liquefier comprising an upper wall configured such that the vaporized and compressed working liquid is condensable at the upper wall and drips down from top to bottom; and an intermediate bottom configured to collect a dripped-down working liquid, wherein the intermediate bottom comprises at least one opening through which the dripped-down working liquid may reach the vaporizer bottom, wherein the intermediate bottom is configured such that one or several deepest possible points are at a periphery of the cooling device, and such that a dripped-down working liquid on the intermediate bottom runs from a central area to the periphery, and wherein the at least one opening is a drill hole that is present at the periphery, dimensioned such that it acts as a throttle between the vaporizer and the liquefier.

24. The cooling device according to claim 23, wherein the periphery comprises at least three corners, and a drill hole is present at each corner, or a drill hole comprises a diameter of less than 6 mm and more than or equal to 0.5 mm.

25. A transport device or building, comprising:

an interior space;

the cooling device according to claim 23, wherein the cooling device is arranged at the transport device or the building such that the vaporizer bottom is arranged in the interior space, and wherein the upper wall of the liquefier is in thermal contact with an area around the transport device or outside of the interior space of the building.

26. The cooling device according to claim 23, wherein the vaporizer bottom is configured to be brought into direct contact with an area to be cooled, in use, and/or wherein the upper wall of the liquefier is configured to be brought into direct contact with an area to be heated, in use.

27. The cooling device according to claim 23, wherein the compressor is configured as a turbo compressor comprising a compressor wheel, a conduction path for a working vapor conveyed by the compressor wheel, and a drive motor for the compressor wheel, wherein the vaporizer is configured as a lower unit, and wherein the liquefier is configured as an upper partial unit, wherein the vaporizer wheel and the conduction space are located between the lower unit and the upper partial unit, and wherein the drive motor extends into the upper partial unit.

28. The cooling device according to claim 23 configured to use water as a cooling agent, wherein the liquefier is configured to operate at a liquefier pressure below 300 mbar, and wherein the vaporizer is configured to operate at a vaporizer pressure that is less than the liquefier pressure and is below 150 mbar.

29. The cooling device according to claim 23 comprising a cuboid-shaped dimension with a height of less than 50 cm and a length or width of less than 100 cm.

30. The cooling device according to claim 23 wherein a wall thickness of the upper wall and/or the vaporizer bottom is less than 1 mm, or wherein the vaporizer bottom or the upper wall are made of metal.

31. A cooling device, comprising:

a vaporizer for vaporizing a working liquid, wherein the working liquid is held on a vaporizer bottom;

a compressor for compressing a vaporized working liquid, wherein the compressor is configured to convey the vaporized working liquid from a bottom of the cooling device to a top of the cooling device in a setup direction that is adopted for the operation of the cooling device;

a liquefier comprising an upper wall configured such that the vaporized and compressed working liquid is condensable at the upper wall and drips down from top to bottom; and an intermediate bottom configured to collect a dripped-down working liquid, wherein the intermediate bottom comprises at least one opening through which the dripped-down working liquid may reach the vaporizer bottom, wherein a liquefier-side ventilator and a vaporizer-side ventilator are arranged to generate an air flow past the vaporizer bottom or the upper wall, respectively, wherein a motor axis is connected to both ventilators to drive the ventilators with a single motor.

32. The cooling device according to claim 31, wherein the liquefier-side ventilator is arranged to be driven by an external flow of a cooling medium, wherein the vaporizer-side ventilator is able be driven without a motor, wherein a controller is further configured to monitor a rotational speed of a ventilator, and, in case of too little a rotational speed, to increase the rotational speed by means of the motor, and/or, in case of too large a rotational speed, to generate electrical power by means of the motor in a generator operation.

33. A transport device or building, comprising:

an interior space;

the cooling device according to claim 31, wherein the cooling device is arranged at the transport device or the building such that the vaporizer bottom is arranged in the interior space, and wherein the upper wall of the liquefier is in thermal contact with an area around the transport device or outside of the interior space of the building.

34. The cooling device according to claim 31, wherein the vaporizer bottom is configured to be brought into direct contact with an area to be cooled, in use, and/or wherein the upper wall of the liquefier is configured to be brought into direct contact with an area to be heated, in use.

35. The cooling device according to claim 31, wherein the compressor is configured as a turbo compressor comprising a compressor wheel, a conduction path for a working vapor conveyed by the compressor wheel, and a drive motor for the compressor wheel, wherein the vaporizer is configured as a lower unit, and wherein the liquefier is configured as an upper partial unit, wherein the vaporizer wheel and the conduction space are located between the lower unit and the upper partial unit, and wherein the drive motor extends into the upper partial unit.

36. The cooling device according to claim 31 configured to use water as a cooling agent, wherein the liquefier is configured to operate at a liquefier pressure below 300 mbar, and wherein the vaporizer is configured to operate at a vaporizer pressure that is less than the liquefier pressure and is below 150 mbar.

37. The cooling device according to claim 31 comprising a cuboid-shaped dimension with a height of less than 50 cm and a length or width of less than 100 cm.

38. The cooling device according to claim 31 wherein a wall thickness of the upper wall and/or the vaporizer bottom is less than 1 mm, or wherein the vaporizer bottom or the upper wall are made of metal.

39. A cooling device, comprising:

a vaporizer for vaporizing a working liquid, wherein the working liquid is held on a vaporizer bottom;

a compressor for compressing a vaporized working liquid, wherein the compressor is configured to convey the vaporized working liquid from a bottom of the cooling device to a top of the cooling device in a setup direction that is adopted for the operation of the cooling device;

a liquefier comprising an upper wall configured such that the vaporized and compressed working liquid is condensable at the upper wall and drips down from top to bottom; and an intermediate bottom configured to collect a dripped-down working liquid, wherein the intermediate bottom comprises at least one opening through which the dripped-down working liquid may reach the vaporizer bottom, the cooling device further comprising a drip tray outside of a vaporizer space of the cooling device in order to collect a condensate from the vaporizer bottom or from an element in thermal interaction with the vaporizer bottom, wherein the cooling device further comprises a conduit configured to bring the collected condensate into thermal interaction with an outside of the upper wall in order to generate an adiabatic cooling for the upper wall.

40. A transport device or building, comprising:

an interior space;

the cooling device according to claim 39, wherein the cooling device is arranged at the transport device or the building such that the vaporizer bottom is arranged in the interior space, and wherein the upper wall of the liquefier is in thermal contact with an area around the transport device or outside of the interior space of the building.

41. The cooling device according to claim 39, wherein the vaporizer bottom is configured to be brought into direct contact with an area to be cooled, in use, and/or wherein the upper wall of the liquefier is configured to be brought into direct contact with an area to be heated, in use.

42. The cooling device according to claim 39, wherein the compressor is configured as a turbo compressor comprising a compressor wheel, a conduction path for a working vapor conveyed by the compressor wheel, and a drive motor for the compressor wheel, wherein the vaporizer is configured as a lower unit, and wherein the liquefier is configured as an upper partial unit, wherein the vaporizer wheel and the conduction space are located between the lower unit and the upper partial unit, and wherein the drive motor extends into the upper partial unit.

43. The cooling device according to claim 39 configured to use water as a cooling agent, wherein the liquefier is configured to operate at a liquefier pressure below 300 mbar, and wherein the vaporizer is configured to operate at a vaporizer pressure that is less than the liquefier pressure and is below 150 mbar.

44. The cooling device according to claim 39 comprising a cuboid-shaped dimension with a height of less than 50 cm and a length or width of less than 100 cm.

45. The cooling device according to claim 39 wherein a wall thickness of the upper wall and/or the vaporizer bottom is less than 1 mm, or wherein the vaporizer bottom or the upper wall are made of metal.

46. A method for manufacturing a cooling device, comprising:

arranging a vaporizer for vaporizing a working liquid so that the working liquid is held on a vaporizer bottom, and above a liquefier, wherein the liquefier comprises an upper wall configured such that, at the upper wall, a vaporized working liquid compressed by a compressor is condensable and drips down from top to bottom; and arranging an intermediate bottom such that a dripped-down working liquid is collected, wherein the intermediate bottom comprises at least one opening through which the dripped-down working liquid may reach the vaporizer bottom, wherein the intermediate bottom is configured such that one or several deepest possible points are at a periphery of the cooling device, and such that a dripped-down working liquid on the intermediate bottom runs from a central area to the periphery, and wherein the at least one opening is a drill hole that is present at the periphery, dimensioned such that it acts as a throttle between the vaporizer and the liquefier.

* * * * *